United States Patent [19]

Endo et al.

[11] Patent Number: 4,656,334

[45] Date of Patent: Apr. 7, 1987

[54] BED WARMER WITH A BODY TEMPERATURE SENSOR FOR STOPPING A HIGHER PRESET TEMPERATURE

[75] Inventors: Shinichi Endo, Yamatokoriyama; Kunio Kimata, Tsuzuki; Hideho Shinoda, Yamatokoriyama; Kunio Ogita, Ikoma, all of Japan

[73] Assignee: Matsushita Electric Industrial Co., Ltd., Osaka, Japan

[21] Appl. No.: 738,970

[22] Filed: May 29, 1985

[30] Foreign Application Priority Data

Jun. 6, 1984 [JP] Japan ..... 59-115986

[51] Int. Cl.[4] ..... H05B 1/02

[52] U.S. Cl. ..... 219/212; 219/505

[58] Field of Search ..... 219/212, 505, 494, 497, 219/501, 504, 217

[56] References Cited

U.S. PATENT DOCUMENTS

| | | | |
|---|---|---|---|
| 3,141,948 | 7/1964 | Young | 219/494 |
| 3,564,203 | 2/1971 | Naoi et al. | 219/212 |
| 4,315,141 | 2/1982 | Mills et al. | 219/212 |
| 4,315,142 | 2/1982 | Henault | 219/494 |
| 4,359,626 | 11/1982 | Potter | 219/212 |
| 4,430,560 | 2/1984 | Mills et al. | 219/212 |
| 4,485,296 | 11/1984 | Ueda et al. | 219/212 |
| 4,549,074 | 10/1985 | Matsuo | 219/212 |

FOREIGN PATENT DOCUMENTS

| | | | |
|---|---|---|---|
| 1479577 | 7/1977 | United Kingdom | 219/212 |

*Primary Examiner*—M. Jordan

*Attorney, Agent, or Firm*—Stevens, Davis, Miller & Mosher

[57] ABSTRACT

In a bed warmer such as an electric blanket initially subject to a preparatory high temperature set value, the supply of power to a heater is controlled such that a warmer temperature is automatically recovered to a preset temperature value provided by a temperature setter from the preparatory high temperature set value when a bodily temperature detector detects that the user has goes to bed.

7 Claims, 6 Drawing Figures

BED WARMER WITH A BODY TEMPERATURE SENSOR FOR STOPPING A HIGHER PRESET TEMPERATURE

BACKGROUND OF THE INVENTION

1. Field of the Invention

This invention relates to a bed warmer such as an electric blanket.

2. Description of Prior Art

In recent years, an electric blanket has widely been used as a bed warmer. In general use of the electric blanket, it is considered to be preferable that pre-heating or preparatory supply of power is effected in advance for about one hour by setting a knob serving as a temperature set means to a scale "high" and subsequently the knob is set to a lower scale of preference when the user goes to bed. Such an operation is always required upon the use of the electric blanket. But the user often goes to sleep while the knob is still set to the "high" scale in the course of the preparatory supply of power, resulting in a problem that due to oppressive heat, the user is forced to wake up.

FIGS. 1*a* and 1*b* illustrate a conventional bed warmer in which only a knob is provided for adjustment of a preparatory supply of power. The bed warmer comprises a blanket body 1, a heater conductor 2 wired in the blanket body 1, a controller 3 incorporating a control unit for controlling supply of power to the heater conductor 2 and a power supply circuit, and a temperature control knob 4 mounted in the controller 3.

FIGS. 2 shows a temperature characteristic when the electric blanket is in use. A temperature response illustrated in FIG. 2 is obtained by initially setting the knob to a scale "high" at a time a so as to effect preparatory supply of power for about one hour and subsequently setting the knob to a scale of preference at a time b at which the user goes to bed.

SUMMARY OF THE INVENTION

The present invention contemplates elimination of the conventional drawbacks and has for its object to provide a safe and easy-to-operate bed warmer which detects a body (human body) temperature to complete automatic recovery of warming temperature to a value indicated by a preset knob scale.

To accomplish the above object, according to the invention, a body temperature detector is provided for detecting a body temperature, and an output signal of the body temperature detector is used to complete an automatic recovery of warming temperature from a preparatory "high" temperature set value to a value indicated by a preset means.

This construction eliminates the necessity of daily repetition knob operations and permits the provision of a safe and easy-to-operate bed warmer.

DESCRIPTION OF THE PREFERRED EMBODIMENT

The invention will now be described by way of example with reference to FIGS. 3 to 5.

Figure 1:
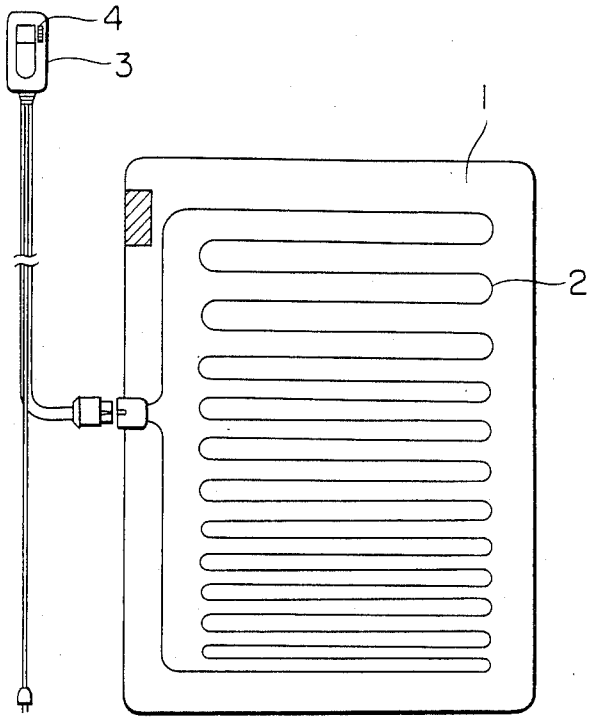
FIG. 1*a* is a schematic view of a conventional electric blanket.
FIG. 1*b* is a perspective view of the conventional electric blanket.
Figure 1:
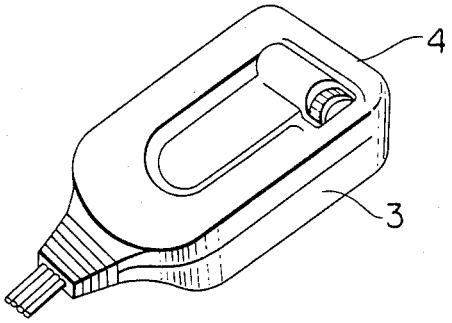
Figure 2:
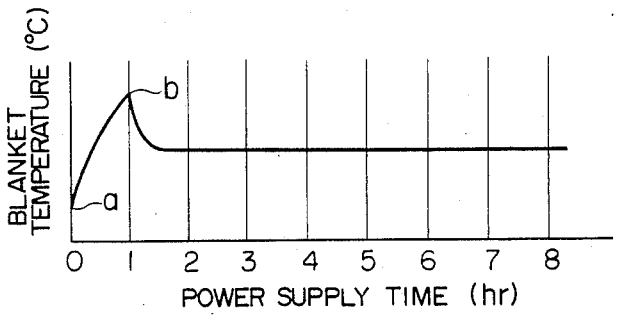
FIG. 2 is a graph showing a temperature characteristic obtained with the conventional electric blanket when a knob is manually set to effect pre-heating for one hour and subsequently set to a lower scale of preference.
Figure 3:
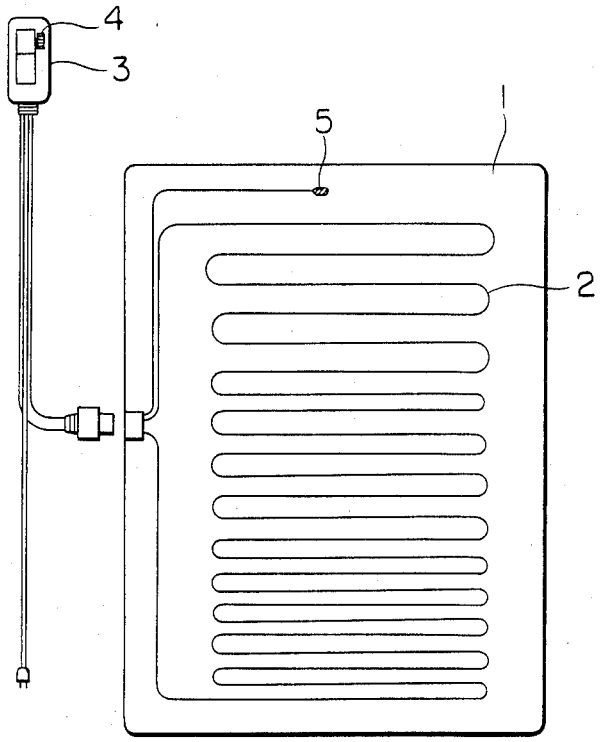
FIG. 3 is a schematic view showing an electric blanket according to an embodiment of the invention.

As schematically shown in FIG. 3, a bed warmer as implemented in the form of an electric blanket comprises components identical to those of the FIG. 1 electric blanket, which are designated by identical reference numerals and will not be described herein, and a body temperature detector 5.

Figure 4:
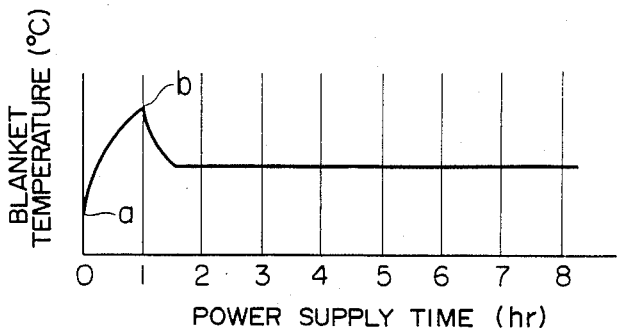
FIG. 4 shows a temperature characteristic of the electric blanket of FIG. 3.

When the electric blanket of this embodiment is operated, a temperature characteristic as graphically shown in FIG. 4 is obtained which depicts a preparatory supply of power for high temperature and subsequent automatic recovery of warming temperature to a preset value after detection of a body temperature.

Figure 5:
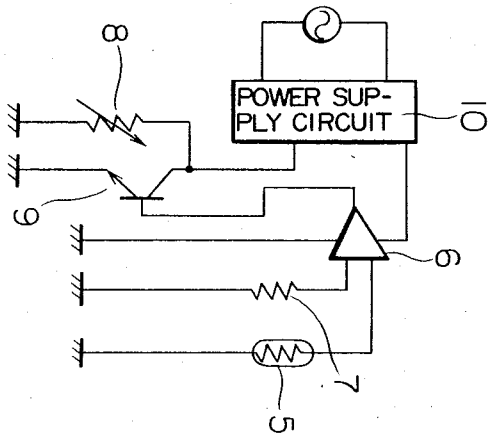
FIG. 5 is a block diagram showing a control circuit of the FIG. 3 electric blanket.

FIG. 5 shows, in block form, a control circuit of the FIG. 3 bed warmer. The control circuit, particularly blocked by dotted line, comprises a voltage comparator 6 which compares one input voltage from the body temperature detector 5 with the other input voltage, i.e., a reference voltage set by a resistor 7 so as to produce an output signal for on-off control of a transistor 9, and a variable resistor 8 for temperature control which is interlocked with the temperature control knob 4 which operates as a temperature preset means. When the transistor 9 responsive to the output signal of the voltage comparator 6 is turned on, the variable resistor 8 is short-circuited. Reference numeral 10 denotes a power supply circuit fed from commercial power source.

The heater conductor 2 wired in the blanket body 1 is of a single wire type which is effective for heat generation and detection of temperatures of generated heat. The bodily temperature detector 5 is mounted in a shoulder port of the blanket body 1 which is immune to influence of heat generated by the heater conductor 2.

In operation, when the power supply circuit is turned on, the short-circuiting transistor 9 of the control circuit shown in FIG. 5 is turned on to automatically establish a preparatory "high" temperature setting and the warming temperature is raised. At this time, the temperature control knob 4 mounted to the controller 3 is preset to a scale indicative of a temperature of preference which gives a comfortable feeling to the user during sleep. In this manner, the preparatory supply of power is initiated by the automatic setting of a preparatory "high" temperature set value simultaneously with turn-on of the power supply circuit. Subsequently, when the user goes to bed, a body temperature is detected by the detector 5 and a voltage indicative of a detected temperature is compared at the voltage comparator 6 with the reference voltage across the resistor 7. When the detected voltage exceeds the reference voltage, the transistor 9, which has short-circuited the variable resistor 8, is turned off so that the warming temperature can automatically be recovered to a value of preference preset by the temperature control knob 4.

The bed warmer constructed above can advantageously safeguard against inadvertent negligence of pre-heating and danger of a burn at low temperatures due to failure to deactivate the pre-heating and eliminate troublesome repetitive operations of setting the preparatory "high" temperature value and the subsequent temperature value of preference.

The invention is in no way limited to the foregoing embodiment which has been explained by way of example of the electric blanket and the single-wire type heater having integral heater conductor and detection conductor but it may be implemented with an electric carpet, a bed ped and the like and a double-wire type heater having a different configuration from the single-wire type heater.

As described above, since, in the bed warmer according to the invention, the warmer temperature can be automatically recovered to the temperature value preset by the temperature preset means from the "high" temperature set value for the preparatory supply of power generally effected in the bed warmer such as an electric blanket when the user goes to bed and a body temperature is detected by the body temperature detector, it is possible to eliminate such problems as inadvertent negligence of pre-heating setting, troublesome setting of the temperature setter after the pre-heating and an uncomfortable feeling due to the oppressive heat caused when the user goes to sleep with the pre-heating kept continued.

What is claimed is:

1. A bed warmer comprising:

a warmer body;

heater means provided on said warmer body;

first detector means for detecting a temperature of said warmer body;

setting means for setting a temperature value of said warmer body;

control means for controlling the supply of power to said heater means so that the temperature of said warmer body detected by said first detector means becomes the temperature value set by said setting means; and, second detector means for detecting a temperature of a human body to indicate the presence of a human body in proximity to said second detector;

said control means including a high temperature holding means for setting said heater means to provide an initial high temperature when power is first supplied to the bed warmer, and release means for releasing the high temperature of said heater means set by said high temperature holding means when said second detector means detects the presence of a human body.

2. A bed warmer according to claim 1 wherein said control means comprises circuit means responsive to a turn-on of said control means to provide a preparatory high temperature setting.

3. A bed warmer according to claim 1 wherein said body temperature detector is mounted in a shoulder portion of said warmer body.

4. A bed warmer according to claim 2 wherein said body temperature detector is mounted in a shoulder portion of said warmer body.

5. A bed warmer comprising:

a warmer body;

a heater means provided on said warmer body;

temperature preset means for providing a preset temperature value of said warmer body;

a body temperature detector for detecting a human body temperature and producing an output signal;

control means for controlling supply of power of said heater means such that a temperature of said warmer body equals the preset temperature value provided by said temperature preset means;

said control means being responsive to the body temperature detector output signal to control the supply of power to said heater means such that the temperature of said warmer body is automatically reduced from a preparatory high temperature set value to the preset temperature value, said control means comprising a variable resistor interlocked with said temperature preset means, a transistor operative to short-circuit said variable resistor, and a voltage comparator responsive to the body temperature detector output to on-off control said transistor.

6. A bed warmer according to claim 1 wherein said second detector means is provided on a shoulder portion of said warmer body.

7. A bed warmer according to claim 1 wherein said control means sets said heater means to provide a temperature for said bed warmer which corresponds to said temperature value set by said setting means, when said high temperature is released.

* * * * *